US007229316B2

(12) United States Patent
Takaku et al.

(10) Patent No.: US 7,229,316 B2
(45) Date of Patent: Jun. 12, 2007

(54) CONNECTOR HAVING AN IMPROVED EFFECT OF PREVENTING AN UNLOCKING LEVER FROM BEING DAMAGED

(75) Inventors: Masaaki Takaku, Tokyo (JP); Kazushi Kamata, Aomori (JP); Shuuichi Ishida, Aomori (JP); Akira Kimura, Tokyo (JP)

(73) Assignees: Japan Aviation Electronics Industry, Limited, Tokyo (JP); JAE Hirosaki, Ltd., Hirosaki-shi, Aomori (JP)

( * ) Notice: Subject to any disclaimer, the term of this patent is extended or adjusted under 35 U.S.C. 154(b) by 0 days.

(21) Appl. No.: 11/266,511

(22) Filed: Nov. 3, 2005

(65) Prior Publication Data

US 2006/0110970 A1 May 25, 2006

Related U.S. Application Data

(62) Division of application No. 10/866,896, filed on Jun. 14, 2004, now Pat. No. 6,966,789.

(30) Foreign Application Priority Data

Jun. 11, 2003 (JP) ..... 2003-166570

(51) Int. Cl.
*H01R 13/648* (2006.01)

(52) U.S. Cl. ..... 439/607

(58) Field of Classification Search ..... 439/607, 439/108, 609, 378, 608
See application file for complete search history.

(56) References Cited

U.S. PATENT DOCUMENTS 3,651,432 A * 3/1972 Henschen et al. ..... 333/33
5,073,130 A 12/1991 Nakamura
5,213,533 A * 5/1993 Walden ..... 439/372
5,620,329 A * 4/1997 Kidd et al. ..... 439/248
6,146,203 A 11/2000 Elco et al.
6,146,210 A * 11/2000 Cha et al. ..... 439/680
6,273,753 B1 * 8/2001 Ko ..... 439/579
6,338,635 B1 1/2002 Lee
6,354,875 B1 3/2002 Wu
6,443,760 B2 * 9/2002 Hasegawa ..... 439/489
6,544,050 B1 * 4/2003 Ko ..... 439/108
6,616,473 B2 * 9/2003 Kamata et al. ..... 439/352

(Continued)

FOREIGN PATENT DOCUMENTS

JP 04-019977 1/1992

(Continued)

OTHER PUBLICATIONS

European Search Report.

*Primary Examiner*—Phuong Dinh
(74) *Attorney, Agent, or Firm*—Collard & Roe, P.C.

(57) ABSTRACT

In a connector having a conductive contact held by an insulator, a lock spring is held by the insulator and adapted to lock a connected state with a mating connector. A conductive shell covers the contact and the insulator. A lever is disposed adjacent to the lock spring. The lever is adapted to operate the lock spring and surrounded by a lever protecting portion serving as an operation inhibiting portion which is for limiting an operating direction of the lever and prevents an excessive displacement of the lever.

1 Claim, 11 Drawing Sheets

U.S. PATENT DOCUMENTS

| | | | | |
|---|---|---|---|---|
| 6,619,985 | B1 * | 9/2003 | Ko | 439/607 |
| 6,814,605 | B2 * | 11/2004 | Masumoto | 439/353 |
| 6,905,371 | B2 | 6/2005 | Yi-Tse | |
| 2003/0104726 | A1 | 6/2003 | Masumoto | |
| 2004/0235324 | A1 * | 11/2004 | Kimura et al. | 439/108 |

FOREIGN PATENT DOCUMENTS

| | | |
|---|---|---|
| JP | 9 12 0864 | 5/1997 |
| JP | 2002-190351 | 7/2002 |
| TW | 507962 Y | 10/2002 |

* cited by examiner

CONNECTOR HAVING AN IMPROVED EFFECT OF PREVENTING AN UNLOCKING LEVER FROM BEING DAMAGED

CROSS REFERENCE TO RELATED APPLICATIONS

Applicants claim priority under 35 U.S.C. 119 of Japanese application JP 2003-166570, filed on Jun. 11, 2003. Applicants also claim priority under 35 U.S.C. 120 and 35 U.S.C. 121 as a divisional of parent U.S. patent application Ser. No. 10/866,896, filed Jun. 14, 2004 now U.S. Pat. No.6,966,789.

BACKGROUND OF THE INVENTION

This invention relates to a connector having a locking mechanism for locking a connected state with a mating connector.

For example, a connector disclosed in Japanese Patent Application Publication (JP-A) No. H9-120864 comprises a connector body and a strain relief connected to the connector body. The strain relief comprises a holding portion faced to the connector body, a first arm portion extending from the holding portion, a locking claw disposed near a free end of the first arm portion and adapted to lock a connected state with a mating connector, a second arm portion extending from the free end of the first arm portion in a direction opposite to the first arm portion, and an operating portion formed at a free end of the second arm portion and adapted to operate the locking claw. The strain relief is provided with a recessed portion for receiving an operating protrusion formed on the operating portion.

When the connector body is connected to the mating connector, the locking claw is engaged with the mating connector to lock the connected state. If the operating portion is forced and pushed in a predetermined direction during the connected state, the locking claw is disengaged from the mating connector. In this event, the first and the second arm portions are cooperated with each other to serve as an unlocking lever for unlocking the connected state. As a result, the mating connector and the connector body are disconnected from each other. When the operating portion is forced and pushed, the operating protrusion is butted against a bottom surface of the recessed portion. With this structure, the unlocking lever is prevented from being damaged when an excessive load is applied to the operating portion.

However, in case where the operating portion is applied with a load in a direction other than the predetermined direction, the first and the second arm portions may be deformed in an unexpected direction to make the unlocking lever be damaged.

SUMMARY OF THE INVENTION

It is therefore an object of the present invention to provide a connector which is compact and is capable of protecting an unlocking lever for unlocking a connected state with a mating connector from various loads and of preventing an erroneous operation.

Other objects of the present invention will become clear as the description proceeds.

According to the present invention, there is provided a socket connector comprising an insulator having a fitting hole for receiving a mating connector, a plurality of conductive contacts disposed in the fitting hole to be connected to a plurality of signal contacts of the mating connector, and a ground contact disposed in the fitting hole, faced to the conductive contact, and adapted to be connected to a shell of the mating connector, the fitting hole having a connection hole for receiving a connecting portion of the mating connector and guide post holes continuous from opposite ends of the connection hole, the guide post holes being greater in width than the connection hole, the connection hole and the guide post hole being eccentric from each other.

DESCRIPTION OF THE PREFERRED EMBODIMENT

Figure 1:
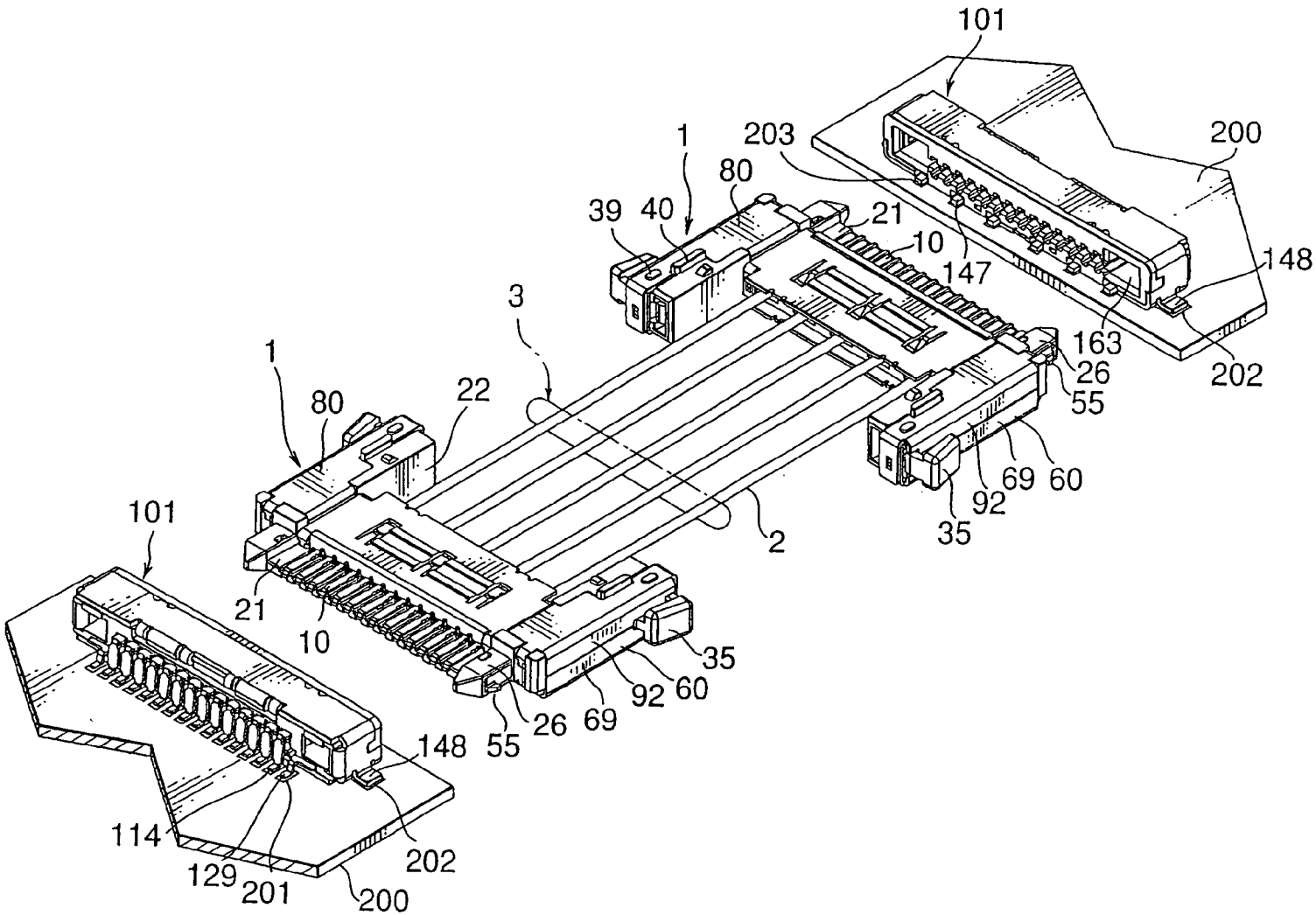
FIG. 1 is a perspective view showing a connection apparatus according to one embodiment of the present invention in an unconnected state, together with two boards.

Referring to FIG. 1, description will be made of a connection apparatus according to one embodiment of the present invention.

The connection apparatus illustrated in the figure serves to electrically connect two circuit boards 200 equipped in various apparatuses. Two cable connectors 1 are connected by a plurality of cables 2 to form a cable harness 3. On each of the circuit boards 200, a board connector 101 is mounted. When the cable connectors 1 are fitted to the board connectors 101, respectively, the boards 200 are connected to each other.

Figure 2:
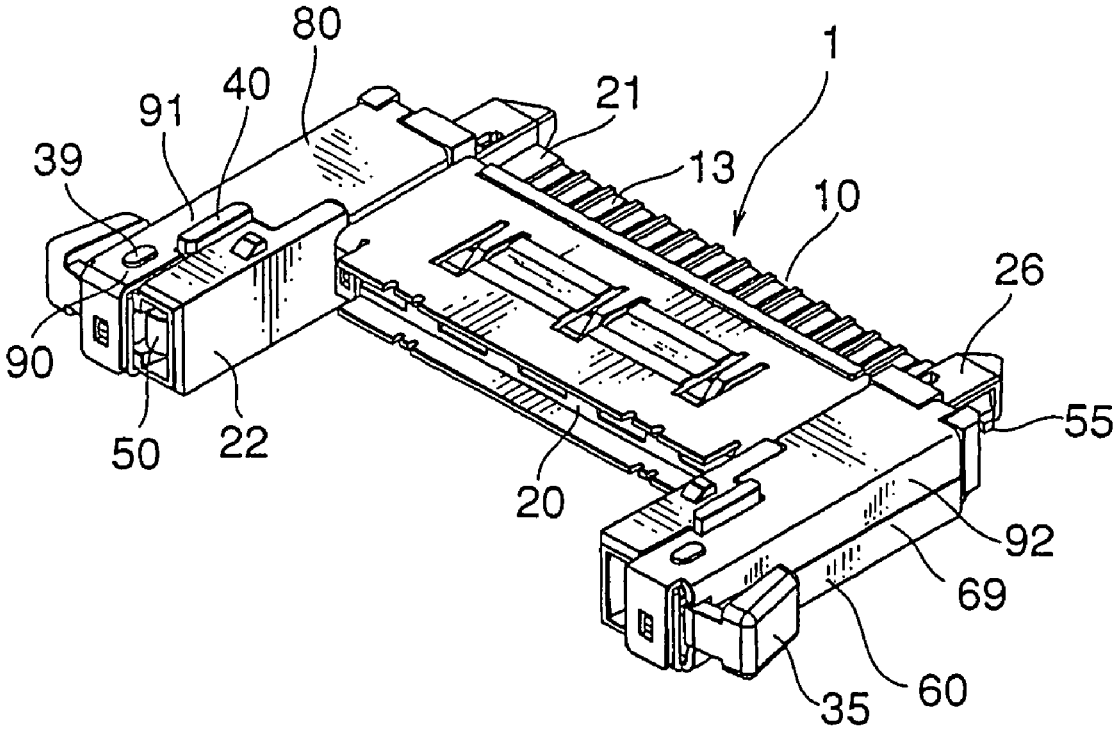
FIG. 2 is a perspective view of a cable connector included in the connection apparatus illustrated in FIG. 1.
Figure 3:
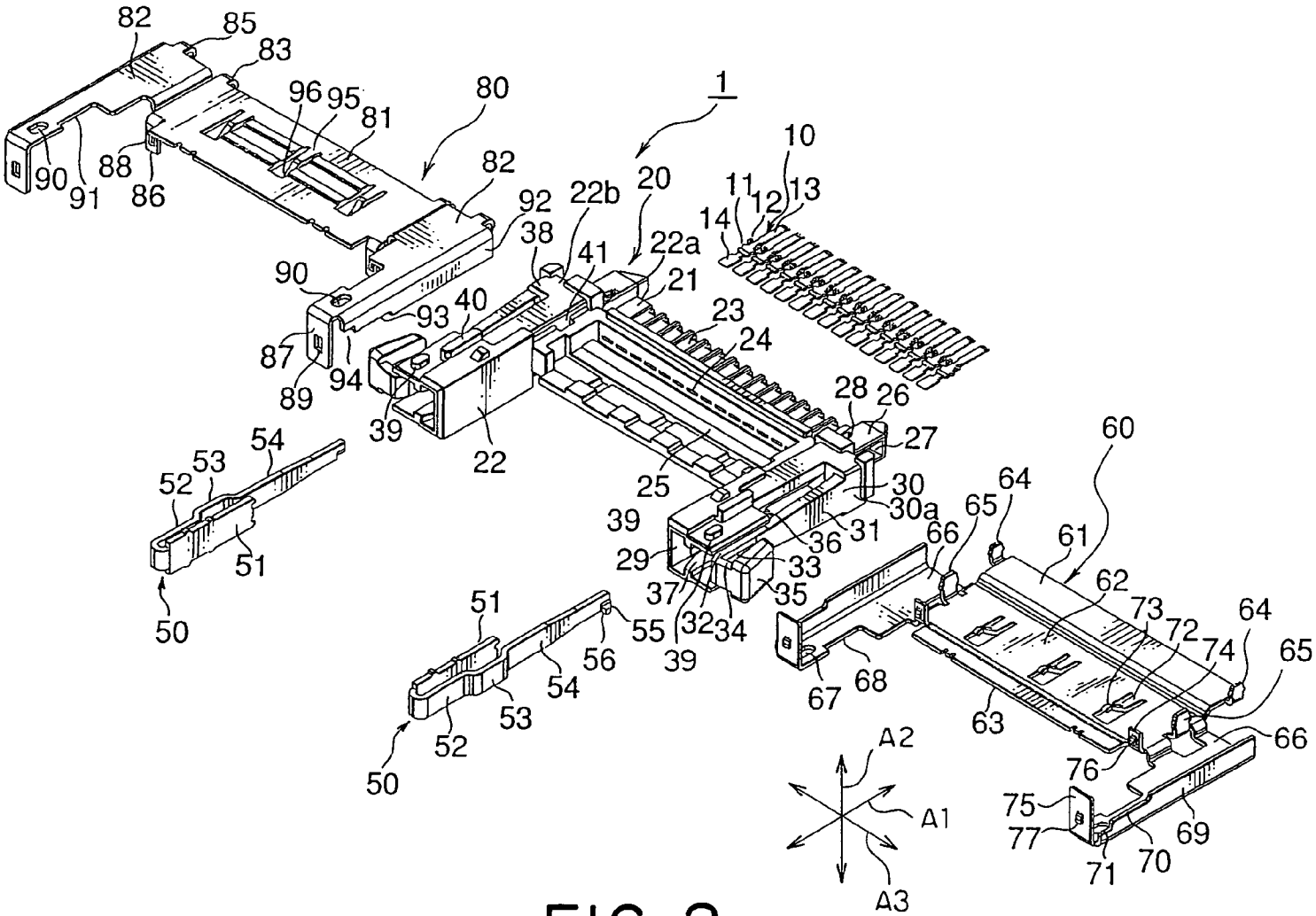
FIG. 3 is an exploded perspective view of the cable connector in FIG. 2.

Referring to FIGS. 2 and 3 in addition to FIG. 1, the cable connector 1 will be described.

The cable connector 1 comprises a plurality of cable contacts 10 having conductivity, a cable insulator 20 holding the cable contacts 10, a pair of lock springs 50, a lower shell 60, and an upper shell 80. Each of the cable contacts 10 is fabricated by press working a metal material and has a press-fit portion 11, an encroached portion 12, a contact point portion 13, and a soldering portion 14 in the manner known in the art. A combination of the lower and the upper shell 60 and 80 is referred to as a conductive shell.

The cable insulator 20 is made of a resin material and has a fitting portion 21 and a main body 22. The fitting portion 21 is formed as a front portion in a first direction A1. The main body 22 is formed as a rear portion in the first direction A1. The fitting portion 21 is provided with a plurality of contact grooves 23. A plurality of contact holes 24 are formed from the contact grooves 23 towards the main body 22, respectively. The contact holes 24 have openings arranged at a wiring portion 25 formed in the main body 22. The fitting portion 21 has opposite ends provided with a pair of guide portions or guide posts 26 integrally formed. The guide posts 26 serve to guide the board connector 101 to be fitted to the cable connector 1. Each of the guide posts 26 has a locking groove 27 formed on an outer side surface thereof and a shell press-fit hole 28 penetrating through upper and lower surfaces thereof. A pair of lock spring press-fit holes 29 are formed at a rear end and on opposite sides of the main body 22.

The cable insulator 20 has opposite side surfaces 30 each of which is provided with a lever 31 having a cantilevered shape and integrally formed. The lever 31 has a beam portion 32, a groove portion 33 made at a free end portion of the beam portion 32, a reinforcing portion 34 adjacent to the groove portion 33, and an operating portion 35 connected to the beam portion 31 through the reinforcing portion 34. The lever 31 is operated around a support portion (support point) 30*a* on the side surface 30. The free end portion of the beam portion 32 are substantially equal to the operating portion 35 in width. The groove portion 33 and the reinforcing portion 34 are smaller in width than the end portion of the beam portion 32.

The lever 31 has a protrusion 36 formed at an intermediate portion and protruding inward. Between the main body 22 and the lever 31, a lever groove 37 is formed. On each of upper and lower surfaces of opposite sides of the main body 22, a stepped portion 38, a pin portion 39, and a projecting portion 40 are formed. Through the upper and the lower surfaces, a shell press-fit hole 41 is formed.

Each of the lock springs 50 is a press-worked product having a generally U-shaped portion. The generally U-shaped portion has a press-fit portion 51 on one side and a base portion 52 and a stepped portion 53 on the other side. The stepped portion 53 is connected to an end portion 54. The end portion 54 has a terminal end as a tapered portion 55. The tapered portion 55 has an engaging portion 56 serving as a locking portion.

The lower shell 60 is a press-worked product made of a metal material. The lower shell 60 has a stepped center portion. The lower shell 60 has a contacting portion 61, a main body 62, and a cable guide portion 63. The contacting portion 61 is provided with press-fit pieces 64 formed at opposite ends. Likewise, the main body 62 is provided with press-fit pieces 65 formed at opposite ends. Outside the press-fit pieces 65, stepped portions are formed to define lever protecting portions 66, respectively. Each of the lever protecting portions 66 has a pin hole 67 and a recessed portion 68. Each of the lever protecting portions 66 has a side surface 69 provided with cut portions 70 and 71. The main body 62 has a spring portion 72 and a contact point portion 73 formed at each of three positions.

Outside of opposite ends of the cable guide portion 63, a pair of standing portions 74 are formed. Similarly, on a rear side of each of the lever protecting portions 66, a standing portion 75 is formed. The standing portions 74 and 75 are provided with protrusions 76 and 77, respectively.

The upper shell 80 is a press-worked product made of a metal material and has a main body 81 at its center and a pair of lever protecting portions 82 at opposite sides. On a front side and on opposite ends of the main body 81, a pair of engaging portions 83 are formed. Likewise, on a front side of each of the lever protecting portions 82, an engaging portion 85 is formed. On a rear side and on opposite ends of the main body 81, a pair of standing portions 86 are formed. Similarly, on a rear side of each of the lever protecting portions 82, a standing portion 87 is formed. The standing portions 86 and 87 are provided with holes 88 and 89, respectively.

Each of the lever protecting portions 82 has a pin hole 90 and a recessed portion 91. Each of the lever protecting portions 82 has an outer side surface 92 provided with cut portions 93 and 94. The main body 81 has a spring portion 95 and a contact point portion 96 formed at each of three positions.

The cable connector 1 is assembled in the following manner.

The press-fit portion 11 of each of the cable contacts 10 is press-fitted to each contact hole 24 of the cable insulator 20. Then, each contact point portion 13 is placed on each contact groove 23 and each soldering portion 14 is placed on the wiring portion 25.

The press-fit portion 51 of each lock spring 50 is press-fitted into each lock spring press-fit hole 29 of the cable insulator 20. Then, the base portion 52, the stepped portion 53, and the end portion 54 are inserted into the lever groove 37. The tapered portion 55 and the engaging portion 56 protrude outward from the locking groove 27 of each guide post 26.

The press-fit pieces 64 and 65 of the lower shell 60 are press-fitted into the shell press-fit holes 28 and 41, respectively. Then, the lower shell 60 is fixed to the cable insulator 20. At this time, the contacting portion 61 is fixed to a lower surface of the fitting portion 21. The lever protecting portions 66 are fitted to the stepped portions 38. The pin holes 67 are fitted over the pin portions on the lower surface of the main body 20. The projecting portions 40 are fitted to the recessed portions 68.

The side surfaces 69 are positioned outside the side surfaces 30 of the cable insulator 20. Between each cut portion 70 and each groove portion 33, a small gap is formed. Likewise, between each cut portion 71 and each reinforcing portion 34, a small gap is formed.

Each cable 2 is soldered to the soldering portion 14 of each cable contact 10. Thereafter, the engaging portions 83 and 85 of the upper shell 80 are engaged with grooves 22*a* and 22*b* formed at an end of the main body 22. The protrusions 76 and 77 of the lower shell 60 are fitted into the holes 88 and 89 of the upper shell 80. Thus, the upper shell 80 is fixed to the cable insulator 20 and the lower shell 60. At this time, the lever protecting portions 82 are fitted to the stepped portions 38 of the cable insulator 20. The pin holes 90 are fitted over the pin portions 39. The recessed portions 91 are fitted to the projecting portions 40.

The side surfaces 92 are positioned outside the side surfaces 30 of the cable insulator 20, respectively. Between each cut portion 93 and each groove portion 33, a small gap is formed. Likewise, between each cut portion 94 and each reinforcing portion 34, a small gap is formed.

Figure 4:
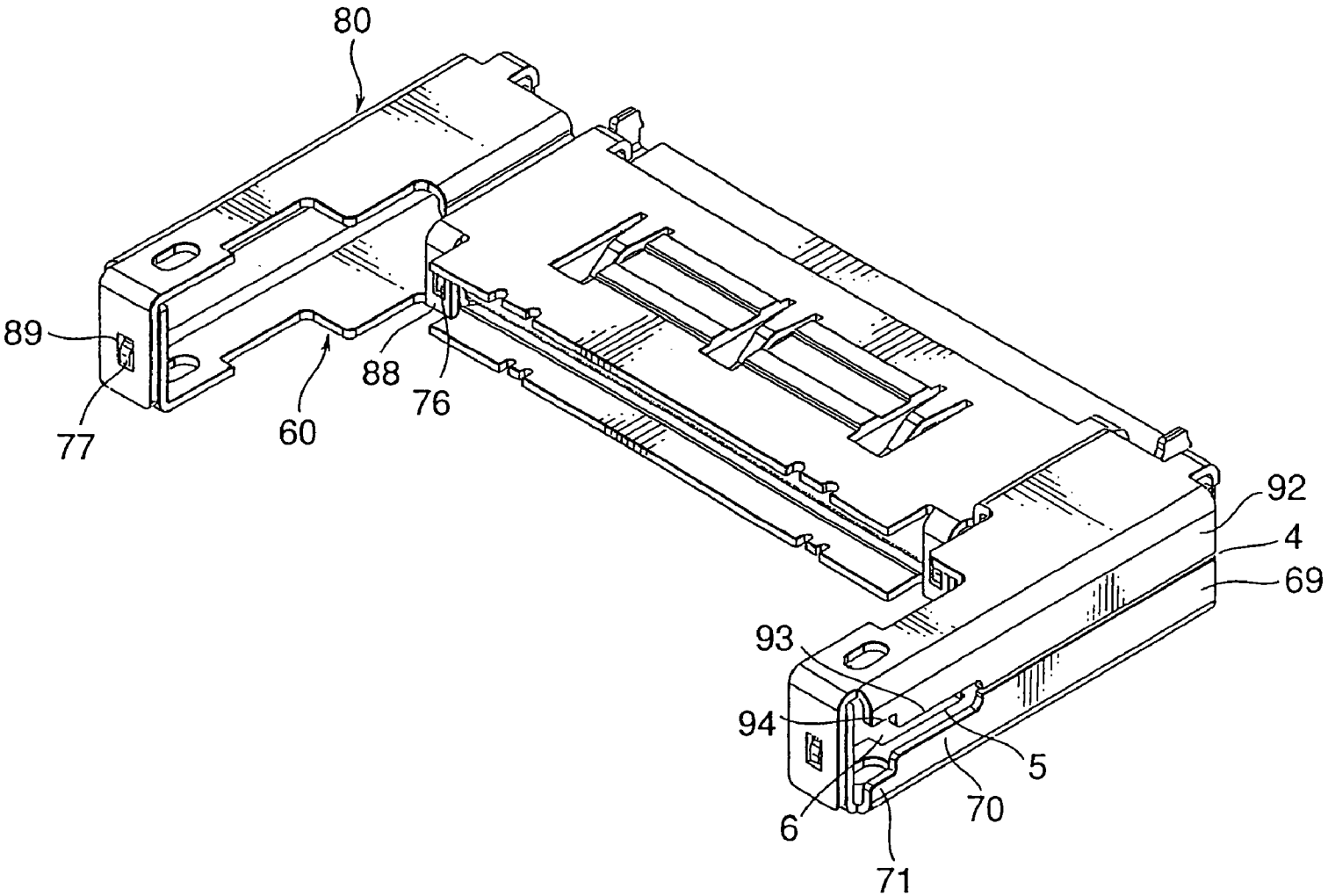
FIG. 4 is a perspective view of a shell included the cable connector illustrated in FIG. 2.

Referring to FIG. 4 in addition, description will be made of the state of the upper and the lower shells 60 and 80 mounted to the cable insulator 20.

Each side surface 69 of the lower shell 60 and each side surface 92 of the upper shell 80 are fixed outside of each side surface 30 of the cable insulator 20 with a small gap 4 left between each side surface 69 of the lower shell 60 and each side surface 92 of the upper shell 80. At this time, a slit 5 is formed by each cut portion 70 and each cut portion 93. The slit 5 has a width smaller than a height of each of the free end portion of the beam portion 32 and the operating portion 35 and slightly greater than a depth of the groove 33. A slit 6 formed by each cut portion 71 and each cut portion 94 has a width smaller than the height of the operating portion 35 and slightly greater than a height of the reinforcing portion 34. The lower and the upper shells 60 and 80 are assembled to the cable insulator 20 so that the slits 5 and 6 face the groove 33 and the reinforcing portion 34, respectively.

Figure 5A:
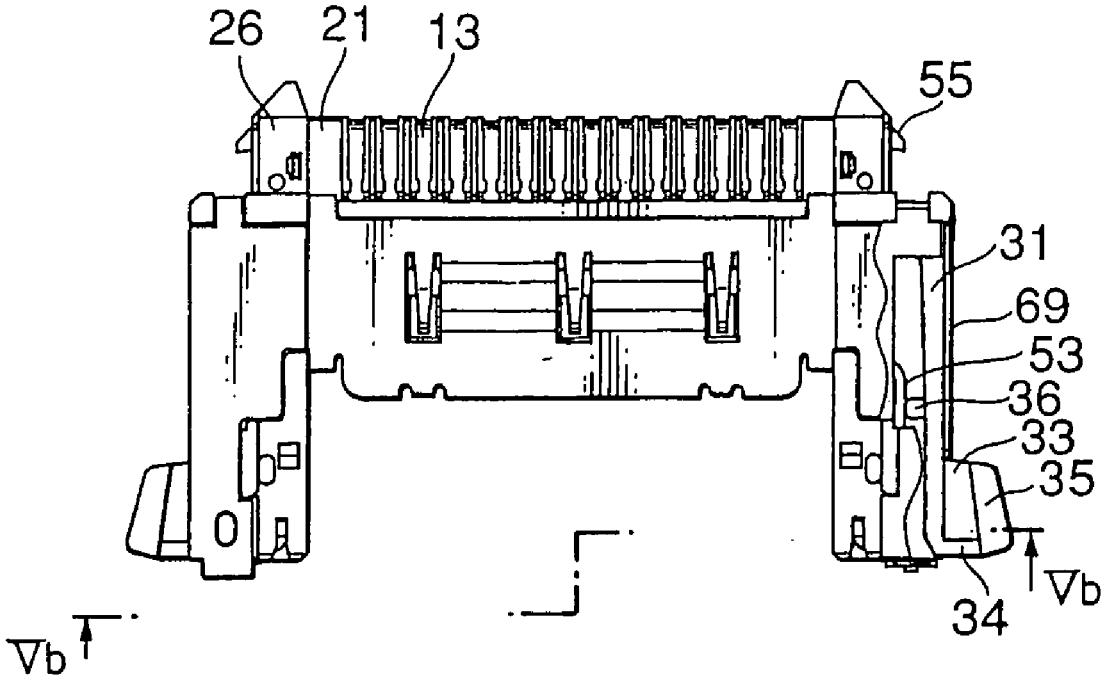
FIG. 5A is a plan view of the cable connector in FIG. 2 in a locked state.
Figure 5B:
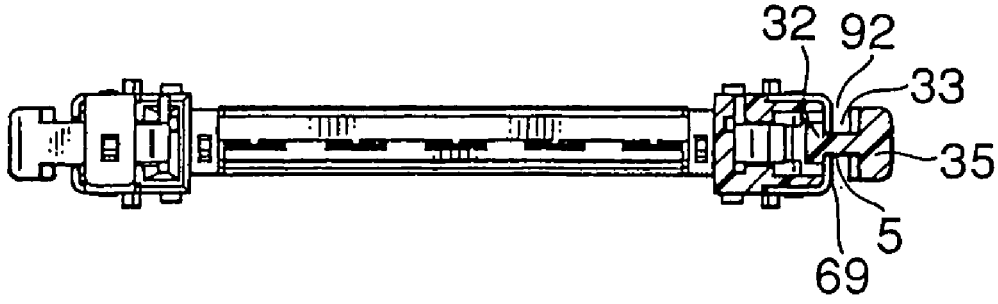
FIG. 5B is a sectional view taken along a line Vb—Vb in FIG. 5A.

In a locked state illustrated in FIGS. 5A and 5B, the tapered portion 55 and the engaging portion 56 of each lock spring 50 protrude outside of each guide post 26. As described above, the height of the free end portion of the beam portion 32 is greater than the width of the slit 5. Therefore, in the locked state, the lever 31 is prevented by the upper and the lower shells 80 and 60 from being opened outward. Therefore, it is impossible to carry out an erroneous operation of pulling the operating portion 35 outward. Since the lever 31 is surrounded by the lever protecting portions 66 and 82, the lever 31 is prevented by the upper and the lower shells 80 and 60 from being moved even if the operating portion 35 is pressed in a vertical direction. Therefore, it is also impossible to carry out an erroneous operation of pressing the operating portion 35 in the vertical direction. Namely, a combination of the lever protecting portions 66 and 82 serves as an operation inhibiting portion for limiting an operation direction of the lever 31 and preventing an excessive displacement of the lever 31.

Figure 6A:
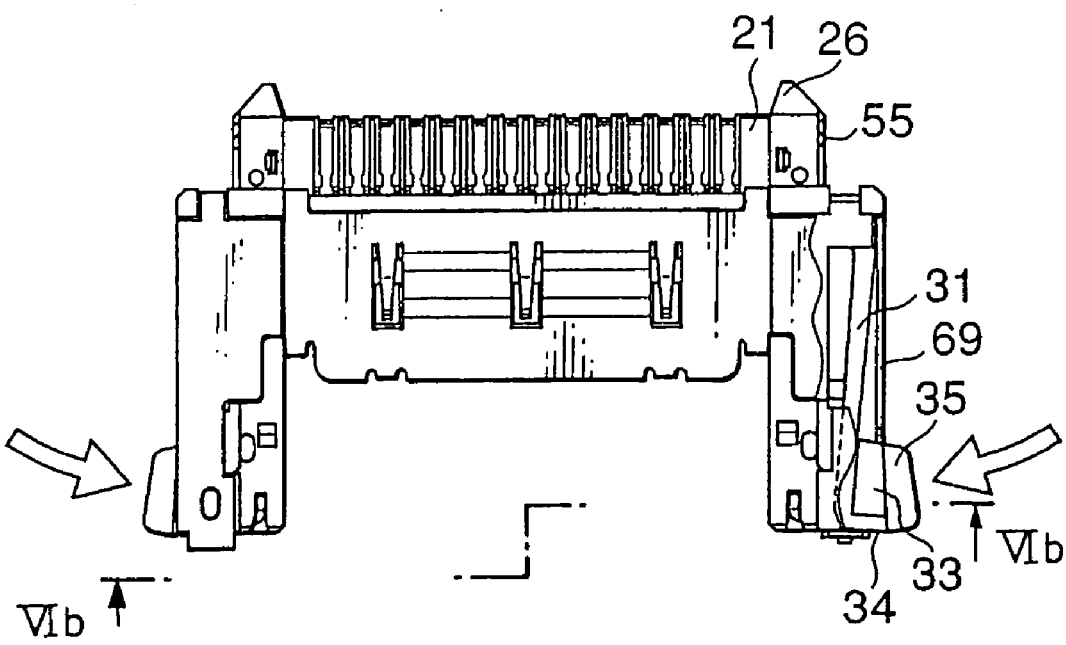
FIG. 6A is a plan view of the cable connector in FIG. 2 in an unlocked state.
Figure 6B:
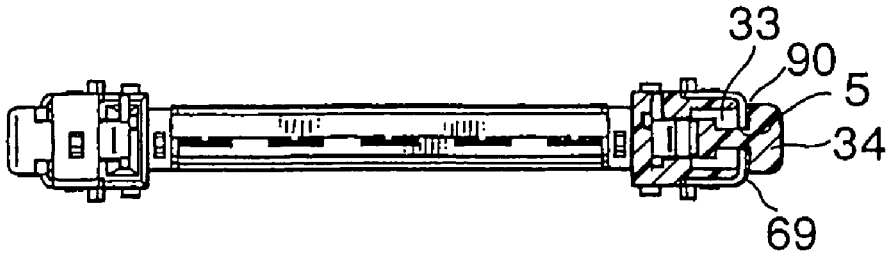
FIG. 6B is a sectional view taken along a line VIb—VIb in FIG. 6A.

When each of the lever operating portions 35 is pushed in a direction depicted by an arrow as illustrated in FIGS. 6A and 6B, each lever 31 is displaced so that each protrusion 36 pushes the stepped portion 53 of each lock spring 50. Accordingly, each lock spring 50 is displaced so that each tapered portion 55 and each engaging portion 56 are retreated inward from the outer side surface of each guide post 26. Thus, an unlocked state is reached.

Each operating portion 35 has a height greater than the width of each slit 5. Each operating portion 35 can be pushed inward until the operating portion 35 is butted against the side surface 92 of the upper shell 80 and the side surface 69 of the lower shell 60. Therefore, each slit 5 serves to stop the operation of each lever 31 so that each lever 31 is prevented from being damaged by an excessive operation amount. Since each operating portion 35 is positioned at a rear end of the cable connector 1, each lever 31 can easily be pushed.

Sometimes, a bundle of a plurality of cable harnesses 3 are commercially distributed. As described above, the lever 31 is surrounded by the lever protecting portion 66 of the lower shell 60 and the lever protecting portion 82 of the upper shell 80. Therefore, even if the cable connectors 1 adjacent to each other are entangled with each other, the lever 31 of a cantilevered shape is hardly damaged. Each pin portion 39 of the main body 22 is fitted to each pin hole 67 of the lower shell 60 and each pin hole 90 of the upper shell 80 while each projecting portion 40 is fitted to each recessed portion 68 and each recessed portion 91. With this structure, the main body 22, the lower shell 60, and the upper shell 80 are hardly broken even if an excessive operating force is applied to the main body 22, the lower shell 60, or the upper shell 80 during an unlocking operation.

When a force pressing each operating portion 35 is reduced, each lever 31 is returned to the locked state illustrated in FIGS. 5A and 5B due to a restoring force of each lock spring 50.

As described above, in the cable connector 1, it is possible to prevent an erroneous operation and an excessive operation of each operating portion 35. In addition, a damage due to an accident during distribution of the cable connector 1 hardly occurs. Further, the main body 22, the lower shell 60, and the upper shell 80 are hardly damaged due to an excessive operating force during the unlocking operation. Since each operating portion 35 is disposed at the rear end of the connector, an operability is excellent.

Figure 7:
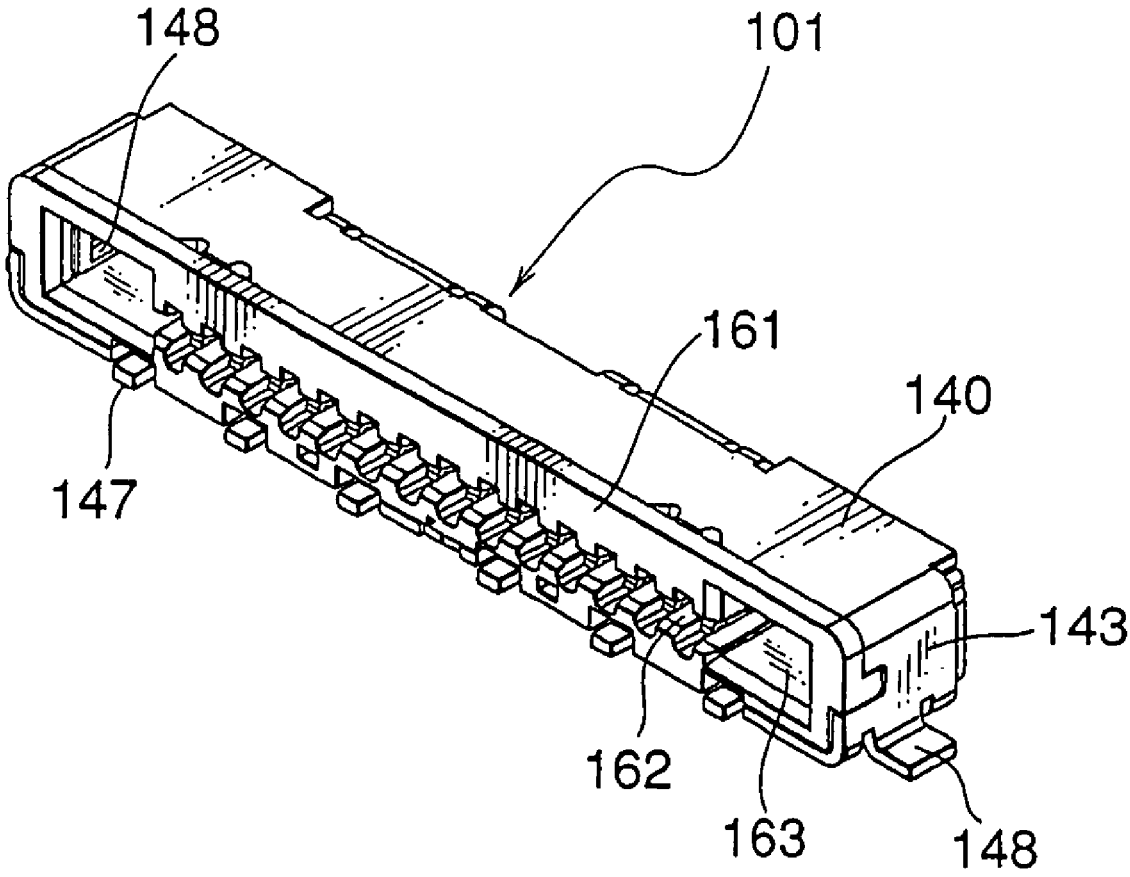
FIG. 7 is a perspective view of a board connector included in the connection apparatus illustrated in FIG. 1.
Figure 8:
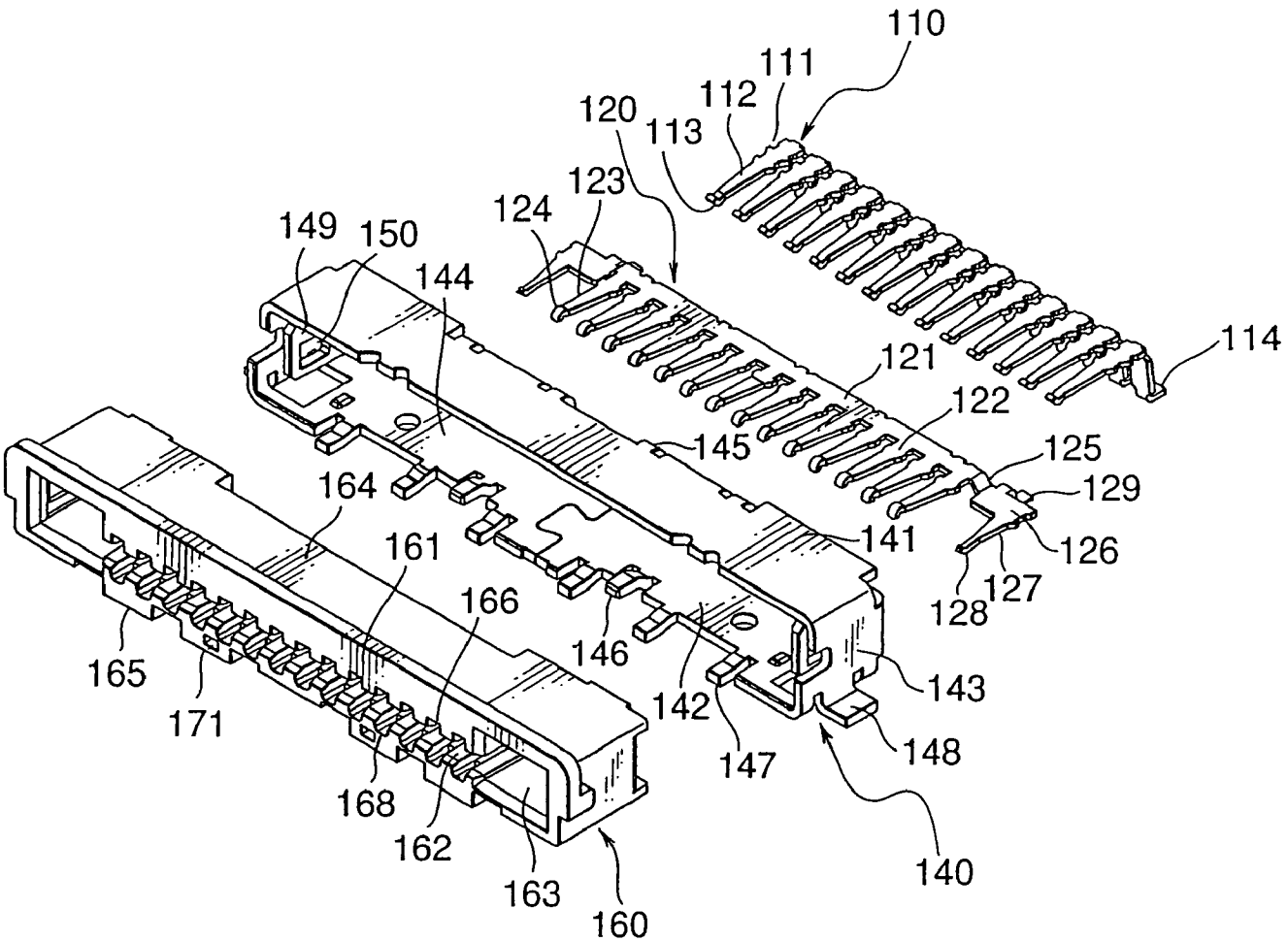
FIG. 8 is an exploded perspective view of the board connector in FIG. 7 as seen from one side.
Figure 9:
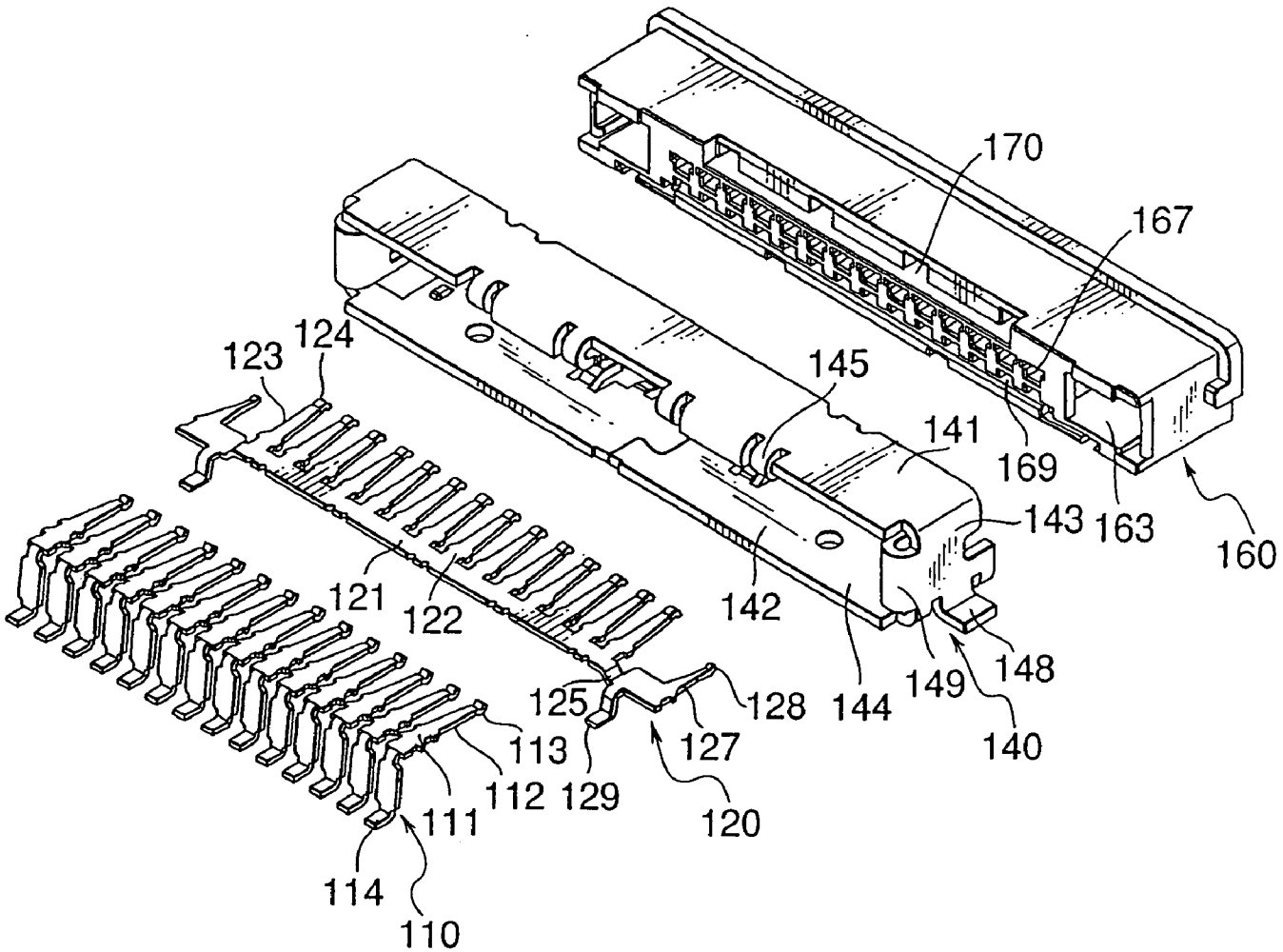
FIG. 9 is an exploded perspective view of the board connector in FIG. 7 as seen from the other side.

Referring to FIGS. 7 through 9, the board connector 101 will be described.

The board connector 101 comprises a plurality of board contacts 110, a ground plate 120, a shell 140, and a board insulator 160. Each of the board contacts 110 has a press-fit portion 111, a spring portion 112, and a contact point portion 113, and a soldering portion 114.

The ground plate 120 has a joint portion 121 formed at its center, a plurality of press-fit portions 122 connected to the joint portion 121, a plurality of spring portions 123 connected to the press-fit portions 122, and a plurality of contact point portions 124 formed at free ends of the spring portions 123, a pair of press-fit portions 126 connected to opposite ends of the joint portion 121 via stepped portions 125, respectively, a pair of spring portions 127 connected to the press-fit portions 126, a pair of shell contact point portions 128 formed at free ends of the spring portions 127, and a pair of soldering portions 129.

The shell 140 is a press-worked product in the form of a rectangular frame having an upper surface 141, a lower surface 142, and opposite side surfaces 143 which define a space 144 receiving the board insulator 160. Several press-fit pieces 145 are formed rearward from the upper surface 141. Frontward from the lower surface 142, several press-fit pieces 146 and several soldering portions 147 are formed. Outward from the opposite side surfaces 143, soldering portions 148 are formed. Inside the opposite side surfaces 143, folded portions 149 are formed. Each folded portion 149 has a locking hole 150.

The board insulator 160 is provided with a plurality of connection holes 162 formed at its center to extend from a front surface 161 thereof and a pair of guide holes 163 formed at opposite sides to extend from the front surface 161. Each connection hole 162 has a plurality of contact grooves 166 formed near an upper surface 164 of the board insulator 160 and a plurality of ground grooves 168 formed near a lower surface 165 of the board insulator 160. Each contact groove 166 has an inner side serving as each contact hole 167. Each ground groove 168 has an inner side serving as each ground hole 169. The upper and the lower surfaces 164 and 165 are provided with several shell press-fit holes 170 and 171 extending from a rear side, respectively.

The board connector 102 is assembled in the following manner.

The shell 140 is fitted to the board insulator 160 from its rear surface. Then, the press-fit pieces 145 are press-fitted to the press-fit holes 170. The press-fit pieces 146 are press-fitted to the press-fit holes 171. The folded portions 149 are inserted into the guide holes 163.

Thereafter, from the rear surface of the board insulator 160, the press-fit portions 122 of the ground plate 120 are press-fitted into the ground holes 169. Then, the contact point portions 124 are received in the ground grooves 168. The press-fit portions 111 of the board contacts 110 are press-fitted into the contact holes 167. Then, the contact point portions 113 are received in the contact grooves 166. As a result, each contact point portion 113 and each contact point portion 124 are disposed in each connection hole 162 to face each other.

Each board connector 101 assembled as described above is fixed to each board 200 by soldering the soldering portions 114, 129, 147, and 148 to lands 201, 202, and 203 of each board 200 as illustrated in FIG. 1.

The cable connector 1 is fitted to the board connector 101 so that each cable contact 10 of the cable connector 1 is faced to each board contact 110 of the board connector 101. Then, the contacts 10 and 110 of the connectors 1 and 101 are contacted with each other so that an electric signal is transmitted. The lower shell 60 and the ground plate 120 are contacted with each other so that a ground signal is transmitted. When the connectors 1 and 101 are fitted to each other, the engaging portion 56 of each lock spring 50 is engaged with each locking hole 150 of the shell 140. Consequently, the connectors 1 and 101 are put into the locked state.

Figure 10A:
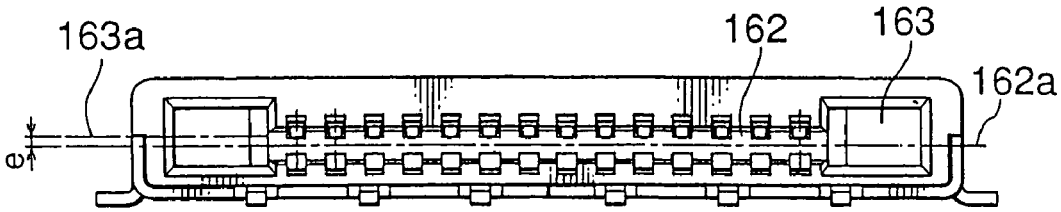
FIG. 10A is a front view of a fitting surface of the board connector in FIG. 7.

As illustrated in FIG. 10A, in the board connector 101, each guide hole 163 has an area wider than that of each connection hole 162. The guide hole 163 and the connection hole 162 have center lines 163*a* and 162*a* eccentric from each other by a dimension e.

Figure 10B:
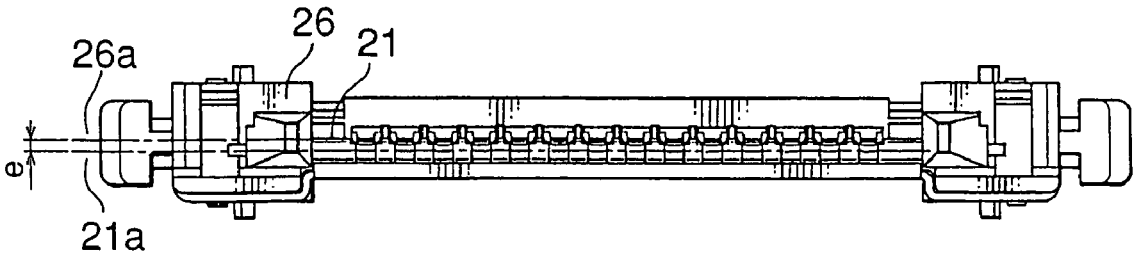
FIG. 10B is a front view of a fitting surface of the cable connector in FIG. 2.

As illustrated in FIG. 10B, in the cable connector 1, each guide post 26 has a thickness greater than that of the fitting portion 21. The guide post 26 and the fitting portion 21 have center lines 26*a* and 21*a* eccentric from each other by the dimension e equal to that in the board connector 101.

Figure 11A:
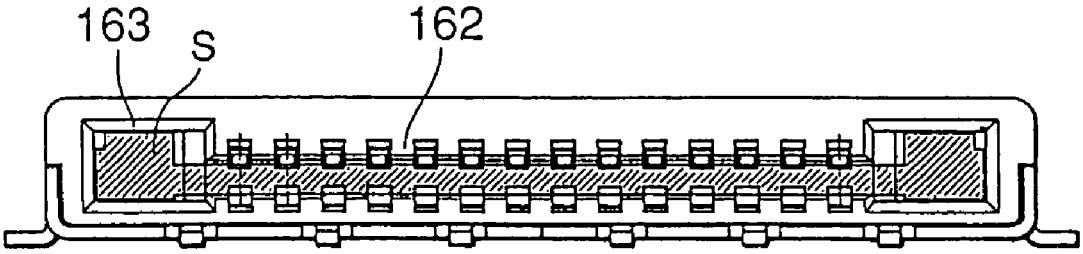
FIG. 11A is a view for describing a case where the cable connector in FIG. 2 is fitted to the board connector in FIG. 7 in a normal position.

In FIG. 11A, a hatched portion S represents a profile of the fitting portion 21 and the guide posts 26 of the cable connector 1. When the board connector 101 and the cable connector 1 are fitted to each other in a normal direction, the hatched portion S can normally be inserted into the connection holes 162 and the guide holes 163.

Figure 11B:
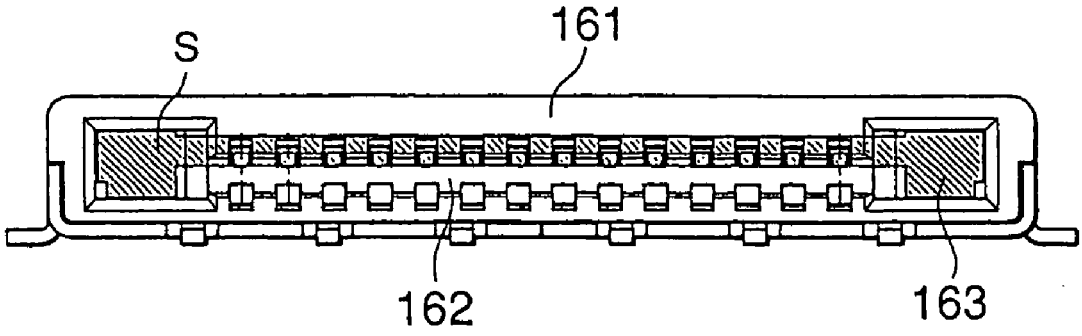
FIG. 11B is a view for describing a case where the cable connector in FIG. 2 is fitted to the board connector in FIG. 7 in a reversed position.

As illustrated in FIG. 11B, if the board connector 101 and the cable connector 1 are fitted to each other in a reverse direction, the center portion of the hatched portion S, i.e., a whole of the fitting portion 21 of the cable connector 1 in a widthwise direction is butted against the front surface 161 of the board connector 101. Therefore, fitting in the reverse direction is impossible. Thus, the connectors 1 and 101 are cooperated with each other to form a reverse-fit preventing connector arrangement.

An insertion force upon fitting in the reverse direction acts as a load applied in a direction of separating the board connector 101 from the board 200. However, since a plurality of soldering portions 147 and 148 are soldered below the connection holes 162, the board connector 101 can strongly resist against such separating load. Since the fitting portion 21 and the guide posts 26 of the cable connector 1 are integrally formed, the guide posts 26 are hardly broken even if insertion or removal is carried out with pitching or rolling or yawing of the cable connector 1.

In the above-mentioned cable connector 1, it should be noted that the cable contacts are disposed on one surface of the front portion of the cable insulator 20 in a second direction A2 perpendicular to the first direction A1. The lower shell 60 is fixed as a connecting portion to the other surface of the front portion of the cable insulator 20 in the second direction A2. The connecting portion has opposite ends in a third direction A3 perpendicular to the first and the second directions A1 and A2. The opposite ends are provided with the guide posts 26 each of that is greater in dimension in the second direction A2 than the connecting portion and formed integral with the cable insulator 60. The connecting portion and each of the guide posts 26 have widthwise centers eccentric from each other in the second direction A2.

While this invention has thus far been described in conjunction with the preferred embodiment thereof, it will be readily possible for those skilled in the art to put this invention into practice in various other manners without departing from the scope of this invention.

What is claimed is:

1. A socket connector comprising:

an insulator having a fitting hole for receiving a mating connector;

a plurality of conductive contacts disposed in said fitting hole to be connected to a plurality of signal contacts of said mating connector;

a shell surrounding an outer peripheral portion of said insulator, said shell being incorporated into said insulator in a direction reverse to a fitting direction of said mating connector, said shell having a first soldering portion extending in said reverse direction and a second soldering portion extending in a direction perpendicular to said reverse direction; and a ground plate comprising:

a plurality of contact point portions disposed in said fitting hole, facing said conductive contacts, and adapted to be connected to a shell of said mating connector;

a joint portion joining said contact point portions; and a pair of spring portions connected to opposite ends of said joint portion, respectively, each of said spring portions having a shell contact portion for contacting said shell, said fitting hole having a connection hole for receiving a connecting portion of said mating connector and guide post holes continuous from opposite ends of said connection hole, said guide post holes being greater in width than said connection hole, said connection hole and said guide post holes being eccentric from each other.

* * * * *